United States Patent [19]

Bedenk et al.

[11] Patent Number: 4,817,788

[45] **Date of Patent: * Apr. 4, 1989**

[54] LAMINATED LAUNDRY PRODUCT

[75] Inventors: William T. Bedenk; Kendall L. Harden, both of Cincinnati, Ohio

[73] Assignee: The Procter & Gamble Company, Cincinnati, Ohio

[ * ] Notice: The portion of the term of this patent subsequent to Jan. 27, 2004 has been disclaimed.

[21] Appl. No.: 924,226

[22] Filed: Oct. 29, 1986

Related U.S. Application Data

[62] Division of Ser. No. 675,804, Nov. 28, 1984, Pat. No. 4,638,907.

[51] Int. Cl.[4] ..... C11D 17/04

[52] U.S. Cl. ..... 206/0.5; 162/109; 206/820; 383/118

[58] Field of Search ..... 206/0.5; 162/113, 117, 162/157.5, 111, 112; 428/315.5, 136; 156/176; 383/118

[56] References Cited

U.S. PATENT DOCUMENTS

| | | | |
|---|---|---|---|
| 1,075,210 | 10/1913 | Heyl et al. | 206/0.5 |
| 3,920,509 | 11/1975 | Yonemori | 162/157.5 |
| 3,958,055 | 5/1976 | Hadley et al. | 156/176 X |
| 4,133,310 | 1/1979 | Lloyd et al. | 428/136 X |
| 4,191,609 | 3/1980 | Trokhan | 162/113 |
| 4,410,441 | 10/1983 | Davies et al. | 206/0.5 |
| 4,529,480 | 7/1985 | Trokhan | 162/109 |

*Primary Examiner*—Steven Marcus
*Assistant Examiner*—Bryon Gehman
*Attorney, Agent, or Firm*—Leonard Williamson; Robert B. Aylor; Richard C. Witte

[57] ABSTRACT

A through the wash, compact, laminated laundry product (1) comprising powdered laundry actives laminated between two plies, at least one ply of which is a strong wet strength, high stretch tissue (5) having a multiplicity of deeply embossed (stretched) nonconnecting tissue cup-like depressions (2) containing the powdered actives with the other ply (4) covering the cups. The plies are sealed with a glue pattern (22) around the cup rims (5*a*). The high stretch tissue is stretched 15% to 100% to form said deeply embossed (stretched) cups and is made to survive the rigors of a washing machine.

4 Claims, 5 Drawing Sheets

LAMINATED LAUNDRY PRODUCT

CROSS-REFERENCE TO RELATED APPLICATION

This is a divisional application of U.S. Ser. No. 675,804, filed Nov. 28, 1984, now U.S. Pat. No. 4,638,907.

FIELD OF THE INVENTION

The invention relates to multi-compartmentalized laminated laundry actives for washer and dryer use.

BACKGROUND OF THE INVENTION

Many pouched laundry products are known. U.S. Pat. No. 4,410,441, Davis et al., issued Oct. 18, 1983, recognizes the need to separate materials to provide faster release and controlled release of the incompatible materials. It disclosed laminating two different material into two large pouches. Typically, dry powders are laminated between a water-permeable substrate and a water-impermeable substrate. Such prior art product laminates have some drawbacks. For example, certain laundry active materials so laminated are relatively slow to dissolve. In certain other forms the laminate has to be protected with a coating, which coating dissolves or comes apart in small pieces. Examples of other prior art laminates are found in U.S. Pat. No. 4,259,383, Eggensperger et al., issued Mar. 31, 1981; U.S. Pat. No. 4,433,783, Dickinson, issued Feb. 28, 1984; U.S. Pat. No. 4,348,293, Clarke et al., issued Sept. 7, 1982. Also U.S. Pat. No. 4,416,791, Haq, which issued Nov. 22, 1982, discloses a packaging film which contains liquid detergent products. U.S. Pat. No. 4,437,294, Romagnoli, issued Mar. 20, 1984, discloses a volumetric batching device for pouches.

A need is recognized to separate materials to provide fast release or controlled release of incompatible materials. EPA No. 66,463, Haq (Unilever NV), Dec. 8, 1982, discloses a laminated material in a sandwich heat-sealed structure to provide separate compartments and perforations for release of the active materials.

Multi-compartmentalized laminated disinfecting materials comprising minipouches are disclosed in U.S. Pat. No. 4,259,383, supra. This patent does not teach embossed paper which is necessary for the compact containment of sufficient amounts of laundry products. This and other drawbacks in pouched prior art include the failure to recognize how to make a compact as well as an efficient laminated laundry product. The large pouched laundry products contain too much material per pouch which makes them less efficient with respect to rapid and complete dissolution of laundry actives in the wash water.

OBJECTS

An object of the present invention is to make a compact as well as an efficient laminated laundry product whereby laundry actives rapidly and completely dissolve in the wash.

Another object of the present invention is to incorporate into a laminated laundry product a deeply embossed tissue so as to contain a more compact laundry product per square unit area in a multitude of small cells of powder to maximize dissolution efficiency.

Yet another object of the present invention is to provide a strong, high stretch paper for the laminate which can be deeply embossed and prestretched without losing its integrity.

Still another object of the present invention is to provide a superior laminated laundry product for consumer use which contains effective amounts of laundry actives in a convenient sheet form.

An additional object is to separate storage-incompatible laundry actives on one convenient sheet.

Other objects will become apparent from the following disclosure.

SUMMARY OF THE INVENTION

A through the wash, compact, laminated laundry product (1) comprising powdered laundry actives laminated between two plies, at least one ply of which is a strong wet strength, high stretch tissue (5) having a multiplicity of deeply embossed (prestretched) nonconnecting tissue cup-like depressions (2) containing the powdered actives with other ply (4) covering the cups. The plies are sealed with a glue pattern (22) around the cup rims (5*a*). The high stretch tissue is stretched 15% to 100% to form said deeply embossed (prestretched) cups and is made to survive the rigors of a washing machine.

BRIEF DESCRIPTION OF THE DRAWINGS

Although FIGS. 4, 5, 6 and 7 are shown flat, it is understood that the molds may also be mounted on a circular drum, as shown in FIGS. 9 and 10. Thus, flat mold (14) and mold-depositing drum (14) shown in FIGS. 9 and 10 are both numbered (14) for simplicity.

DETAILED DESCRIPTION OF THE INVENTION

Figure 1:
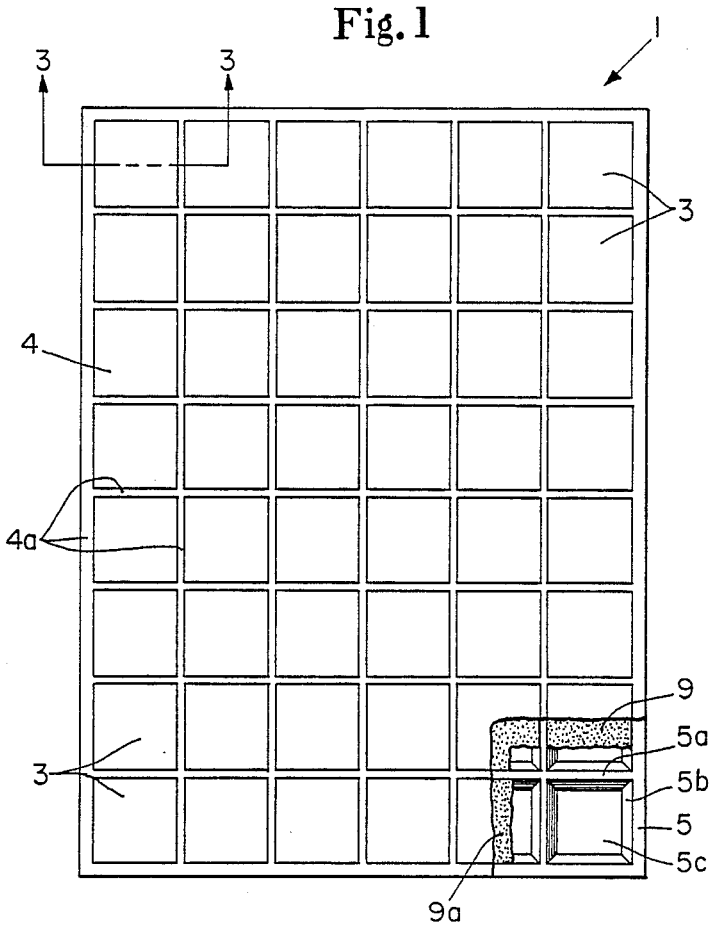
FIG. 1 is a top view of a laminated laundry product showing the tops of a multiplicity of nonconnecting cells (3) containing powdered laundry actives and cups in the cutaway section.

The laminated laundry product comprises two plies at least one of which is tissue with laundry actives contained inside patterned nonconnecting cells. The invention is well-illustrated in the drawings.

FIG. 1 shows a top view of a laminated laundry product (1). The top ply tissue (4) covers the entire product (1) and also shows the multiplicity of cells (3) which are also shown in both FIGS. 1 and 3.

Figure 2:
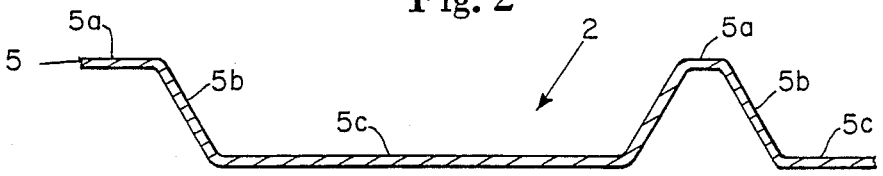
FIG. 2 shows a cross-sectional view of an embossed tissue (5) showing nonconnecting cups (2).
Figure 3:
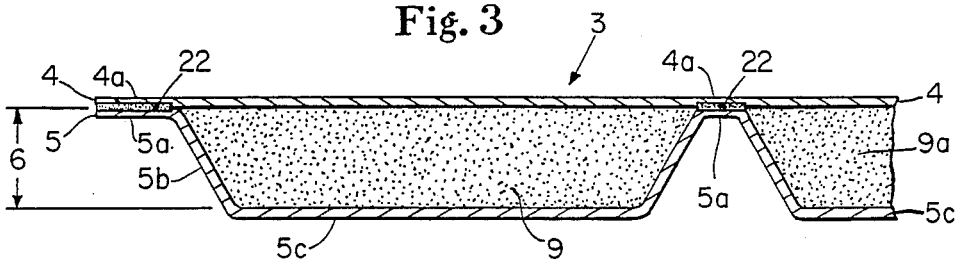
FIG. 3 is a cross-sectional view (3—3) of one of the laminated cells including deeply embossed tissue (5) with nonconnecting cups (2) containing different powdered laundry actives (9 and 9*a*) and a top tissue (4).

FIG. 2 shows the embossed tissue (5) with rim (5*a*), side (5*b*) and base (5*c*). FIG. 3 is a cross-sectional view along lines 3—3 of FIG. 1. The bottom tissue (5) is prestretched at 5*b* about 15% to 100%, preferably 25% to 90%, to a depth (6) of about 2 to 8 mm, preferably 3 to 6 mm. The tissue (5) is embossed (stretched) to form a multiplicity of patterned cups (2) which have sides (5*b*) and a base (5*c*) of cells (3) and with the tops composed of a top tissue (4). The cells are pattern sealed with glue (22) at cup rims (5*a*) and top tissue (4*a*).

The laundry actives (9 and 9*a*) are contained inside the sealed cells (3). Thus, storage incompatible laundry actives are physically separated in the cells.

Figure 5:
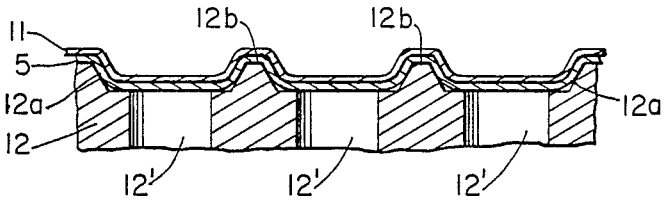
FIG. 5 is the same as FIG. 4 with the addition of a nonporous flexible embossing sheet (11) which seals the vacuum for more effective embossing.

FIGS. 4, 5, 6 and 7 show several methods of embossing the bottom tissue (5) to form the nonconnecting cups. FIG. 5 shows tissue (5) being embossed by vacuum mold (12) using vacuum (12') and a nonporous top sheet (11). The vacuum pulls the nonporous sheet down forcing the tissues down. The tissue (5) is prestretched 15% to 100%, primarily at tissue cup side (5*b*), into the mold cavities (12*a*) over mold lands (12*b*).

Figure 4:
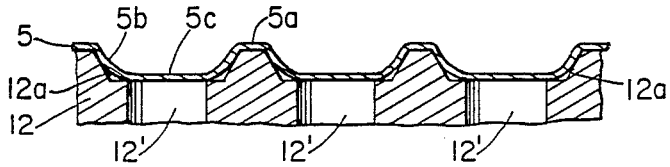
FIG. 4 shows the vacuum mold (12) and the embossment of a tissue (5) whereby the tissue (5) is pulled and prestretched into mold cavities (12*a*) over mold land (12*b*) with vacuum (12').

FIG. 4 shows vacuum embossment without a top sheet. Tissue (5) is sucked into the mold cavity (12*a*) using only vacuum.

Figure 6:
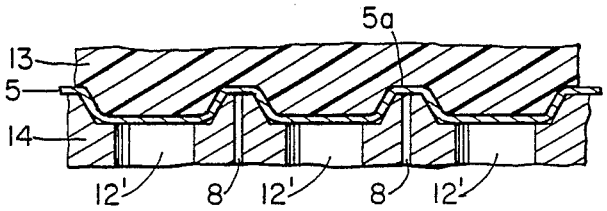
FIG. 6 is a cross-sectional view of a soft rubber embosser (13).
Figure 7:
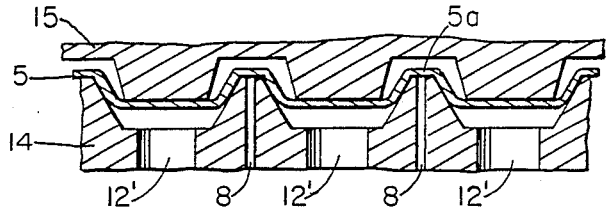
FIG. 7 is a cross-sectional view of a hard embosser (15).
Figure 9:
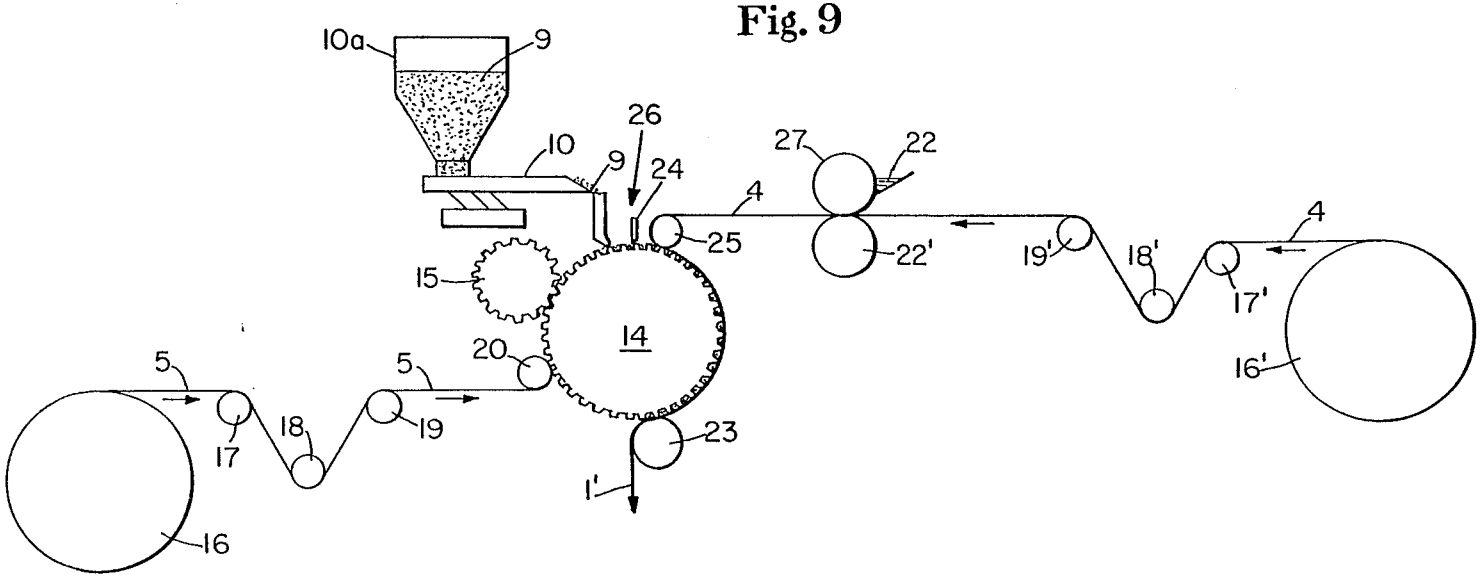
FIG. 9 is a schematic flow diagram of a continuous process for making the laminated laundry product of the present invention.
Figure 10:
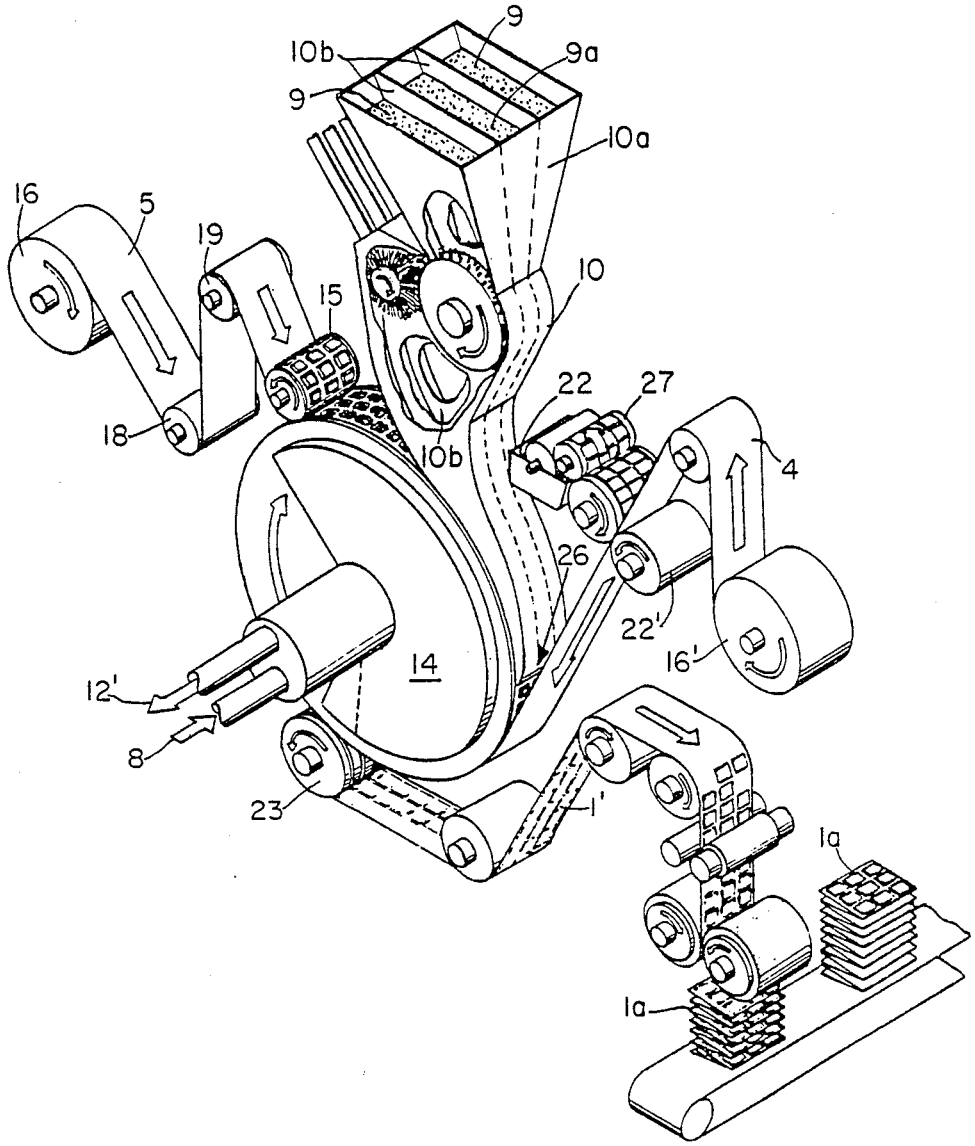
FIG. 10 is a pictorial perspective of a continuous process like that shown in FIG. 9.

FIG. 6 shows a soft rubber embosser (13), tissue (5), and mold (14) with vacuum (12') and blow air (8). The blow air (8) can be used to help remove powder from cup rims (5*a*) in a continuous process as shown in FIGS. 9 and 10. FIG. 7 shows a hard embosser (15) and a mold (14) as shown in FIG. 6.

Figure 8:
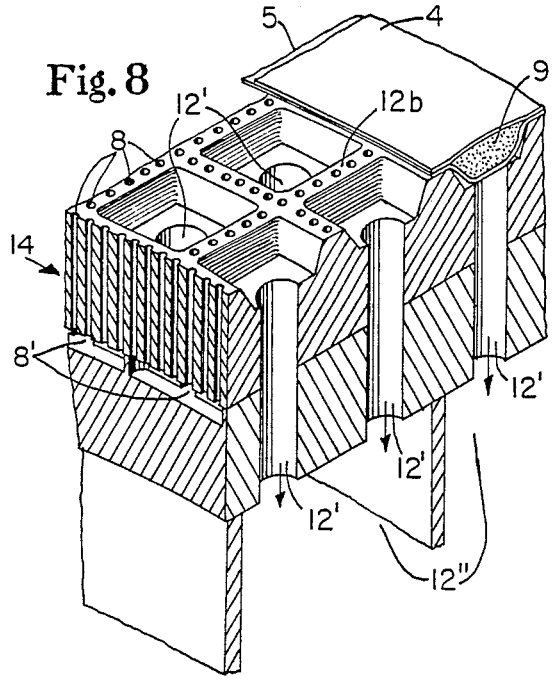
FIG. 8 is a perspective cross-sectional view of the mold of FIG. 6 or 7 showing vacuum (12'), vacuum chamber (12''), blow air (8) and blow air channels (8').

FIG. 8 is a pictorial perspective cross-sectional view of the mold of the type shown in FIGS. 6 and 7.

FIG. 9 shows a continuous process for making the laminated laundry product. A bottom tissue unwind roll (16) with tension rolls (17, 18, 19, and 20) guide the web of tissue (5) onto the mold-depositing drum (14). A hard embosser (15), embosses the tissue (5) as shown in FIG. 7. A soft rubber embosser (13) as shown in FIG. 6 could be substituted for the hard embosser. Laundry powder feeder conveyor (10) deposits metered amounts of powdered laundry actives (9 and 9*a*) into cups (2) as shown in FIG. 2. A doctor knife (24) wipes the powder off the cup rims (5*a*). The doctor knife (24) can be plastic, metal or preferably a soft brush. Blow air (8) as shown in FIG. 6 can also be used to assist in cleaning the cup rims (5*a*) of powder. FIG. 9 also shows a top tissue unwind roll (16') with rolls (17', 18' and 19') which control tension and guide the top web tissue (4) through a patterned hot melt adhesive applicator (27) and backup roll (22'). The top web tissue (4) is further guided around roll (25) to laminating roll (23) which laminates the two plies of tissue together to form a continuous web of laminated laundry product which is then cut into convenient sized sheets (not shown).

FIG. 10 is one embodiment of the apparatus shown in FIG. 9. The convenient sized sheets (1*a*) each with nine cells per sheet are shown. The numbered elements in FIG. 10 correspond to those of FIG. 9 described above.

As shown in FIG. 10, the sheets are preferably cut into rectangular squares ranging from 15 to 50 cm per side and preferably 20 to 40 cm per side. The sheets preferably contain 9 to 60 cells. The sheets can contain 9 to 20 and 36 to 48 cells. Each cell contains from 0.5 to 10 cc of powdered laundry actives, and preferably 1 to 5 cc of powdered laundry actives.

The following is a description of a preferred embodiment of the present invention. An embossed tissue web is covered by an essentially flat tissue web. It is understood that it may be desirable to increase the capacity of each cell. This can be accomplished by embossing the top web as well as the bottom web by using two mold-depositing drums each equipped with vacuum. It is possible to deposit powder on both webs and effectively double the volume of each cell.

It is also understood that the top tissue can be a nonporous ply, but is preferably a porous ply. It is also understood that the top tissue need not have the high stretching capabilities of the embossed tissue.

DETAILS FOR MAKING THE PRODUCT

1. The Tissue Paper

The paper used in the present invention must have certain physical characteristics. It must have multi-directional strength as well as multi-directional stretch (elongation potential) to allow the product of this invention to be made in the first place and to allow the product to withstand the rigors of practical use. Specifically, the paper must have a dry MD tensile strength of from about 1,200 to about 2,400 grams per inch, preferably at least about 1,400 grams per inch, with from about 30% to about 60% stretch, preferably at least about 45% as defined hereinbelow. It must have a dry CD tensile strength of from about 700 to about 1,500 grams per inch, preferably at least about 800 grams per inch, with from about 9 to about 25% stretch, preferably at least about 12%.

In papermaking, directions are normally stated relative to machine direction (MD) and cross machine direction (CD). Machine direction refers to that direction which is parallel to the flow of the paper web through the papermaking machine. Measurements in the machine direction are made on the test specimen parallel to that direction. Cross machine direction is perpendicular to a machine direction. Naturally, cross machine direction measurements are made on the test specification in a direction at right angles to the machine direction.

Total tensile is defined as the arithmetic sum of the MD and CD tensiles. For use in the present invention, a paper should have a dry total tensile of from about 1,800 to about 3,200 grams per inch, preferably at least about 2,000 grams per inch. The ratio of dry MD tensile to dry CD tensile should be from about 1.2 to about 2.2, preferably from about 1.4 to about 2.2.

It must be recognized that products of the present invention are intended to be used in a wet system. Thus, the paper used in the products must have certain properties in the wet state. The paper must exhibit a wet CD tensile strength of from about 200 to about 800 grams per inch, preferably at least about 250 grams per inch. It must also have a wet burst peak force of from about 200 to about 500 grams, preferably at least about 250 grams, with maximum elongation of from about 15% to about 30%, preferably at least about 17%. It should be noted that the elongation percentage is different from the embossment stretch percentage as used herein. It must have a wet energy absorption of from 140 to about 220 gram centimeters, preferably from about 160 to about 200 gram centimeters.

The basis weight of the paper is preferably from about 15 to about 35 pounds per 3,000 square feet, most preferably from about 20 to about 28 pounds per 3,000 square feet.

The paper should have a dry caliper of from about 10 to about 35 mils, preferably from about 20 to about 30 mils. (As used herein, one "mil" is equivalent to 0.001 inch.)

Dry tensile strength is obtained with a Thwing-Albert Model 500 tensile tester such as is available from the Thwing-Albert Instrument Company of Philadelphia, Pa. Product samples measuring 1 in. by 6 in. are cut in both the machine and cross-machine directions. Four sample strips are superimposed on one another and placed in the jaws of the tester which is set at a 2 in. gauge length. The crosshead speed during the test is 4 in. per minute. Readings are taken directly from a digital readout on the tester at the point of rupture and divided by four to obtain the tensile strength of an individual sample. Results are expressed in grams per inch.

Wet tensile strength is measured in a similar manner except the samples are first saturated with distilled water at room temperature.

Stretch is the percent elongation of the sheet, as measured at rupture, and is read directly from a second digital readout on the Thwing-Albert tensile tester. Stretch readings are taken concurrently with tensile strength readings.

Dry caliper is obtained with a Model 549M motorized micrometer such as is available from Testing Machines, Inc. of Amityville, Long Island N.Y. Product samples are subjected to a loading of 80 grams per square inch under a 2-inch diameter anvil. The micrometer is zeroed to assure that no foreign matter is present beneath the anvil prior to inserting the samples for measurement and calibrated to assure proper readings. Measurements are read directly from the dial on the micrometer and are expressed in mils.

Wet burst peak force is measured by forcing a ⅝ inch diameter spherical surface against a circular sample 3½ inches diameter held within an annular clamp. The force required to puncture the sample as the spherical surface is moved through the sample at a constant rate of 5 inches per minute is measured in grams and is the burst strength. Equipment used is the burst tester manufactured by Thwing-Albert Instrument Company. Percent elongation is a measure of the distance the spherical surface moves from first contact with the sample to wet burst relative to an initial (gage) height of 10 cm.

It is desirable that the paper exhibit an area of permeability of from about 80 to about 180 SCFM as measured according to ASTM Method D-737.

Papers useful herein can be made from any convenient papermaking fiber. Preferred are softwood fibers liberated from the native wood by the common Kraft papermaking process. Fibers obtained from hardwoods and fibers obtained by the various mechanical and chemimechical papermaking processes, as well as synthetic papermaking fibers, can also be used. As stated in U.S. Pat. No. 4,529,480, Trokhan, issued July 16, 1985, incorporated herein by reference, in addition to the various wood pulp fibers, other cellulosic fibers such as cotton linters, rayon, and bagasse can be used in this invention. Synthetic fibers such as polyester and polyolefin fibers can also be used and, in fact, are preferred in certain applications.

The requisite strength of the paper can be obtained through the use of various additives commonly used in papermaking. Examples of useful additives include wet strength agents such as urea-formaldehyde resins, melamine formaldehyde resins, polyamide-epichlorohydrin resins, polyethyleneimine resins, polyacrylamide resins, and dyaldehyde starches. Dry strength additives, such as polysalt coacervates rendered water insoluble by the inclusion of ionization suppressors are also useful herein. Complete descriptions of useful wet strength agents can be found in TAPPI Monograph Series Number 29, *Wet Strength Resin in Paper and Paper Board,* Technical Association of the Pulp and Paper Industry (New York 1965), incorporated herein by refernce, and in other common references.

One specific paper found particularly useful in the present invention is the tissue paper described by Trokhan in U.S. Pat. No. 4,529,480, issued July 16, 1985, incorporated herein by reference.

This paper web, which is sometimes known to the trade as a tissue paper web, is characterized as having two distinct regions.

The first is a network region which is continuous, macroscopically monoplanar, and which forms a preselected pattern. It is called a "network region" because it comprises a system of lines of essentially uniform physical characteristics which intersect, interlace, and cross like the fabric of a net. It is described as "continuous" because the lines of the network region are essentially uninterrupted across the surface of the web. (Naturally, because of its very nature paper is never completely uniform, e.g., on a microscopic scale. The lines of essentially uniform characteristics are uniform in a practical sense and, likewise, uninterrupted in a practical sense.) The network region is described as "macroscopically monoplanar" because, when the web as a whole is placed in a planar configuration, the top surface (i.e., the surface lying on the same side of the paper web as the protrusions of the domes) of the network is essentially planar. The network region is described as forming a preselected pattern because the lines define (or outline) a specific shape (or shapes) in a repeating (as opposed to random) pattern.

The second region of the tissue paper web comprises a plurality of domes dispersed throughout the whole of the network region, each being encircled by portions of the network region. The shape of the domes (in the plane of the paper web) is defined by the network region. This second region of the paper web is denominated as a plurality of "domes" for convenience because each section appears to extend from (protrude from) the plane formed by network region when viewed by an imaginary observer examining the tissue paper web from the direction of a first surface of the web. When viewed by an imaginary observer examining the tissue paper web from the direction of the second surface of the web, the second region comprises arcuate shaped voids which appear to be cavities or dimples.

The density (weight per unit volume) of the network region is high relative to the density of the domes.

Those skilled in the art are familiar with the effect of creping on paper webs. In a simplistic view, creping provides the web with a plurality of microscopic or semi-microscopic corrugations which are formed as the web is foreshortened, the fiber-fiber bonds are broken, and the fibers are rearranged. In general, the microscopic or semi-microscopic corrugations extend transversely across the web. That is to say, the lines of microscopic corrugations are perpendicular to the direction in which the web is traveling at the time it is creped (i.e., perpendicular to the machine direction). They are also parallel to the line of the doctor blade which produces the creping. The crepe imparted to the web is more or less permanent so long as the web is not subjected to tensile forces which can normally remove crepe from a web. In general, creping provides the paper web with extensibility in the machine direction. Preferably, the tissue paper web used herein which is creped.

2. A Preferred Specified Papermaking Process

The particularly preferred paper web described above can be made according to the process as specified herein and generally described in the hereinbefore incorporated U.S. Pat. No. 4,529,480 of Trokhan. The process is briefly described in the following paragraphs.

The first step in the process involves providing an aqueous dispersion of papermaking fibers and, optionally, papermaking chemicals. The fibers and chemicals mentioned above can be used. Techniques well known to those skilled in the papermaking art can be used to prepare this dispersion which is sometimes known as a papermaking furnish.

The second step in the process is forming an embryonic web of papermaking fibers from the papermaking furnish on a first foraminous member. The fibers in the embryonic web have a relatively large quantity of water associated with them; consistencies in the range of from about 5% to about 25% are satisfactory. (Percent consistency is defined as 100 times the quotient obtained when the weight of dry fiber in the system under discussion is divided by the total weight of the system.) The embryonic web is generally too weak to be capable of existing without the support of an extraneous element such as the first foraminous member. The fibers within the embryonic web are held together by bonds weak enough to permit rearrangement of the fibers under the action of forces hereinafter described. Any of the numerous techniques well known to those skilled in the papermaking art can be used in the practice of this step. As a practical matter, continuous papermaking processes are preferred. Processes which lend themselves to the practice of this step are described in many references such as U.S. Pat. No. 3,301,746 issued to Sanford and Sisson on Jan. 31, 1967, and U.S. Pat. No. 3,994,771 issued to Morgan and Rich on Nov. 30, 1976, both incorporated herein by reference. The first foraminous member is a fourdrinier wire.

The third step is associating the embryonic web with a second foraminous member (a "deflection member") which is a continuous belt. The second foraminous member has one surface, the embryonic web-contacting surface, which comprises a macroscopically monoplanar network surface which is continuous and patterned and which defines within the second foraminous member a plurality of discrete, isolated, deflection conduits. The deflection conduits are continuous passages connecting the embryonic web-contacting surface with the opposite surface of the deflection member. The deflection member is constructed in such a manner that when water is caused to be removed from the embryonic web (as by the application of differential fluid pressure) in the direction of the foraminous member, the water can be discharged from the system without having to again contact the embryonic web in either the liquid or the vapor state. The network surface is essentially monoplanar and continuous so that the lines formed by the network surface form at least one essentially unbroken net-like pattern. The network surface defines within it the openings of the deflection conduits in the web-contacting surface of the deflection member.

Figure 11:
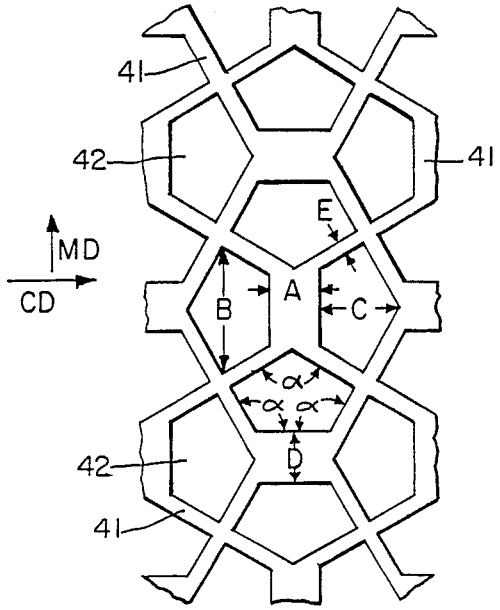
FIG. 11 is a magnified view of the openings of the deflection conduits of a preferred deflection member used to make a high stretch tissue paper.

The openings of the deflection conduits are in the form of irregular pentagons distributed in a regularly repeating array as illustrated schematically in FIG. 11. Reference numeral 42 illustrates the openings of the deflection conduits while reference numeral 41 indicates the network surface. Angles alpha are about 120°. The dimensions of the irregular pentagons and their orientations are: A is about 0.026 inch: B is about 0.068 inch; C is about 0.045 inch; D is about 0.026 inch; and E is about 0.007 inch.

The fourth step is deflecting the papermaking fibers in the embryonic web into the deflection conduits and removing water from the embryonic web through the deflection conduits to form an intermediate web of papermaking fibers. The deflecting is done under such conditions that the deflection of the papermaking fibers is initiated no later than the time at which water removal through the conduits is initiated. Deflection of the fibers is introduced by the application of differential fluid pressure to the embryonic web by exposing the embryonic web to a vacuum in such a way that the vacuum is applied to the second surface of the deflection member and the web is exposed to the vacuum through the deflection conduits. Fibers in the embryonic web are deflected from the plane of the embryonic web into the deflection conduits without destroying the integrity of the web.

The fifth step is predrying the web with a flow-through dryer (hot air dryer) well known to those skilled in the art until the predried web has a consistency of about 75%.

The sixth step is impressing the network pattern of the surface of the deflection member into the predried web to form an imprinted web by pressing the predried web against the surface of a Yankee drum dryer with the deflection member. The surface speed of the Yankee dryer is 0% to 20% less than the surface of the first foraminous member.

The seventh step is drying the imprinted web on the surface of the Yankee dryer (to which it has been adhered with polyvinyl alcohol) to a consistency of about 97%.

The eighth step is foreshortening the dried web by creping it from the surface of the Yankee dryer with a doctor blade.

The preferred papermaking fibers are northern softwood Kraft fibers. A preferred wet strength resin is Kymene 557 H polyamide-epichlorohydrin cationic wet strength resin manufactured by Hercules Incorporated of Wilmington, Del., used at a level of 15–40 pounds per ton of bone dry pulp (which is about 7.5–20 kg of wet strength resin/1000 kg of dry bond pulp). Other additives to the papermaking furnish preferably include 2–6 pounds carboxymethylcellulose per ton of bone dry pulp (1.0–3.0 kg/1000 kg) and 0–20 pounds per ton Hercon 48 waterproofing material made by Hercules Incorporated of Wilmington, Del.

The tissue is normally available in roll form (16). It is unwound either by using a powered drive on the unwind roll or by pulling on the web. A device to control web tension usually is necessary because the paper is light in weight and somewhat elastic. It is important to use low web tensions throughout the system and to control these tensions accurately.

The tissue paper used in this invention is typically different on each side. For optimum bonding, as well as controlling the appearances of the final product, it was found best to position the paper on the unwind stand so the most uneven side of the paper is on the outside of the laminate.

The tissue paper ply is led from the unwind stand through a series of turning rolls and draw rolls as needed to the mold-depositing drum (14) as shown in FIG. 9.

3. Powder Handling

Powders to be laminated into the cells (3) shown in FIG. 3 are stored in conventional hoppers (10*a*), as shown in FIGS. 9 and 10. As needed, they are carried to the mold-depositing drum (14) by any of a number of metering and conveying devices. Typically they can consist of screw conveyors, belt conveyors and vibratory conveyors. Simple metering devices such as vibration feeders, loss-in-weight feeders, rotary valves, fluidized air lines and weight belts can also be used, and the like are well-known in the art. Both volumetric and gravimetric feeders can be used.

It is preferable to give the powders a velocity component similar to the depositing drum speed to minimize settling time. For this reason a curve on the bottom of the entry chute is often helpful. Overall velocity of the powder can be varied by the height of the chute.

One of the key features of the process is the capability of adding two or more powders to the laminated sheet as shown in FIG. 10. When two or more different powders are processed they are kept separated via dividers (10*b*) in the hopper (10*a*). They can be metered to separate rows on the embossed tissue and kept physically separated during processing through merchandising, sale and storage of the product. Thus, storage-incompatible materials can be incorporated on the same sheet without loss in their effectiveness.

4. Mold-Depositing Drum

The mold-depositing drum is of special design and incorporates the following features:

(a) The exterior of the drum is covered with the molds which consist of a series of square or rectangular cavities into which the paper can be embossed. A large range in cavity size is possible. It was found that rectangular cells of from about 0.5 to 3 inches (13 to 76 mm) by 0.5 to 3.0 inches (13 to 76 mm) are especially suited for the process and for the performance of the finished laminated product.

(b) At the bottom of each cavity is a vacuum hole leading to the interior of the drum where there is a cavity in which the air is partially evacuated.

(c) Between each of the cavities on the drum surface are "land" areas preferably about ⅛ inch (3 mm) wide on the top. The lands may contain a series of air blow holes which are connected to a supply of compressed air inside the depositing drum. Air blowing outwardly through these holes and through the covering tissue can help to keep the cup rim (5*a*) areas free from loose powder thus providing a clean surface on the tissue for bonding.

(d) The interior of the mold-depositing drum includes a series of duct-like vacuum holes (12') designed to connect the center of the surface cavities with vacuum and, similarly, blow channels (8') in the land areas are connected with air pressure. These ducting holes and channels lead to the side of the drum and are so constructed that each row of surface cavities can be connected individually with vacuum and air pressure as needed.

Many different arrangements for the internal ducting are possible including large internal plenum chambers as well as ducting immediately below the drum surface. Such arrangements are limited only by the imagination. An added feature that is particularly valuable is a sliding or adjustable block in the ducting system to control the imput positions on the depositing drum which are connected to specific rows of surface activities so that the supply of air and vacuum to the mold-depositing drum can be varied as needed.

Connecting the internal vacuum and air ducting to sources of vacuum and air pressure are sliding valves. Again, many types of valve systems are available to effect a tight seal of a moving part against a stationary one.

5. Embossing Drum

A drum with a soft rubber exterior like shown in FIG. 6 is designed to contact the mold-depositing drum surface cavities such that when paper is applied on the depositing drum, the soft surface of the embossing drum embosses the paper into the cavities. The embossing drum may have surface patterns which match the mold depositing drums. In this case the two drums must run in synchronization. If a smooth, nonpatterned embossing roll is used, speed synchronization may not be needed and the embossing drum can be driven by the mold depositing drum.

An important feature of the mold embossing drum which incorporates the hard embossing is that it can be adjustable so that the depth of the embossing can be carefully controlled. Typically a depth of about 0.21 inch (5 mm) is used but larger or smaller embossing can be used to satisfy parameters such as laminate cell capacity and shape. Obviously, a hard embossing roll must be run in synchronization with the mold-depositing drum.

The shape of a raised embossing knob on the hard embossing roll is important to get maximum embossing depths but it was found that a knob of about 0.25 inch (6 mm) less than the mold cavity in both dimensions (MD and CD) worked well.

6. Depositing Drum Receiver

A receiver section (26) is built onto the top part of the mold roll depositing drum (14) as shown in FIG. 10. This is designed to contain several important parts.

(a) "Sides" (10*c*) to contain the powder when it is first added to the mold-depositing drum. These must be fitted closely to the mold-depositing drum to minimize air flow from the sides.

(b) A doctor knife (24) as shown in FIG. 9 to level the surface of the powder inside the cups; to clean powder from the cup rims (5*a*); and brush away higher piles of powder that might interfere with the bonding. It was found that this doctor knife (24) could be made of many materials, but a soft brush was particularly effective.

(c) As shown in FIG. 10, divider (10*b*) similar in shape to the sides of the hopper (10*a*) and receiver (26) but between the sides of the hopper and receiver (26) can be used to separate different powders and permit two or more completely different materials to be deposited and contained in the laminated product without being in physical contact with each other.

7. Bonding System

The top tissue web (4) is fed from a conventional unwind roll (16') using tension control provided by a simple dancer system.

Ordinarily the tissue is pulled but if needed the unwind roll could be driven by a number of devices commonly used in web handling processes.

A gravure printing system (27) is used to print hot melt adhesive (22) on the tissue web (4) in such a pattern as to match the cup rims and the lands of the mold-depositing drum cavities. Conventional gravure hot melt systems such as furnished by Roto-Therm can be used. From the gravure roll the paper is led over a roller to the depositing roll where an immediate bond is made on the lower tissue (5). A more permanent bond is provided by passing the laminates under a laminating roll (23) where the paper web is compressed and the adhesive driven deeply into the tissue structure.

This is the preferred method of bonding. It is understood that other methods of bonding are also satisfactory. For example, meltable fibers, such as polyester fibers, can be included in the paper furnish, which tissue is then heat sealable. The bonds along the cup rims can be achieved by patterned heating in these areas. Other bonding methods such as needle-punching, high pressure bonding and heat sealing using patterned meltable films are other possible modes of lamination.

OPERATION

Tissue is typically unwound from the roll (16) using only the pull from the mold-depositing roll (14). With stiffer paper, larger rolls, or if any sticking occurs it may be necessary to use driven unwind rolls or separate pull rolls to help unwind. Tension on the paper is controlled with a simple dancer system.

The paper unwinding operation can cause a buildup of static charges on the web which can cause later problems with the powder handling. This is usually dealt with by a combination of increasing ambient relative humidity to at least 50% and by using commercial static eliminators at the appropriate places near the web.

2. The paper is led to the mold-depositing drum (14) and through the nip of the embossing drum (13). Although not normally required, having some vacuum on the cavities at this point helps to stabilize the paper and keep it in place during embossing. The embossing drum (13) may be synchronized with the depositing drum and/or adjusted to the desired depth. Typically a depth of 3.8 mm to 6.4 mm is used for embossing.

3. At a position near the top of the depositing drum (14) of FIG. 9 powder (9) is added. This powder can be added to any part of the depositing drum if it is held by vacuum but about 15° before TDC (top dead center) works well. The powder is added preferably in a waterfall or cascade fashion across the entire web at a rate which matches the overall sheet requirements. For a 12-inch long sheet a powder level of 20 to 100 grams is often desired.

Concurrent with the powder addition both the vacuum and the blow air are turned on. The vacuum greatly aids the quick and accurate settling of the powder into the cavities. In the land area, air blows outwardly through the paper helping to keep the cup rim areas clean for subsequent bonding. The amounts of air pressure and vacuum are controlled and balanced for best performance but typically a vacuum of about 200 to 1,000 mm of water and air pressure of 200 to 500 mm of water work well.

Following the powder deposition the drum (14) rotates under a doctor knife (24) to level the powder in the cups.

4. Hot melt adhesive (22) is applied to the paper over tissue (4) from a gravure cylinder (27) using the desired pattern. Many types of hot melts can be used including polyvinyl acetates, polyethylene, rubbers and the like. Polyamide glues have been particularly favored since they maintain their integrity through a laundering cycle. Solvent based adhesives are also acceptable for the process but need further processing to eliminate the solvent. Whatever type of adhesive is used it should have quick tack properties so the lamination is completed very rapidly. Typically the hot melt glue is printed at about 420° F. The viscosity at this point is about 10,000 centipoises which tends to cause the adhesive to remain on the paper surface until it reaches the combining roll (23).

The upper paper ply (4) with printed hot melt adhesive is led to the mold-depositing drum (14) where it combines with the lower paper ply (5) on the cup rim areas. With the proper adhesive, immediate light bonding is obtained. By then passing under a laminating combining roll (23) with bonding pressures up to 100 pounds per lineal inch the paper is compressed and the adhesive is forced deep into the paper for a permanent bond. Care must be taken to achieve deep penetration of the adhesive into the web so the plies will not delaminate at or near the bonds during a regorous wash cycle. Compression of the tissue papers to a total thickness of 0.13 to 0.65 mm is particularly effective.

After combining, the laminates are led from the depositing drum (14) to a slitting, cutting and folding operation to trim sheets to the final shape for usage as shown in FIG. 10.

The laundry products of this invention contain 20, 50, 150 to 200 cc of laundry active powder per sheet. It will be obvious that a laminated product can be embossed on both sides for increased cell volume.

THE POWDERS

The laundry actives are preferably powders. The powders used in the present invention are typical laundry actives: bleaches, softeners, detergents, etc.

Examples of powdered detergent materials are disclosed in U.S. Pat. No. 4,404,128, B. J. Anderson, issued Sept. 13, 1983, incorporated herein by reference.

Examples of powdered bleach are disclosed in U.S. Pat. No. 4,473,507, F. P. Bossu, issued Sept. 25, 1084, incorporated herein by reference.

EXAMPLE

A typical example of such a product is given below. The materials of the detergent mix and the bleach mix are each separately blended and added to separate rows of the embossed tissue (5). The tissue in this example was embossed with a soft embosser (13) as shown in FIG. 6. In this case the embossing stretch was about 30% to 40% with the greatest stretch at cup sides (5*b*). The embossing stretch here is distributed more uniformly over the total area of the tissue than would have occurred if a hard embosser was used.

It will be understood that the cup sides and base may be a continuous curve. In such cases the 15% to 100% prestretch is primarily in the areas adjacent to the cup rims.

A sheet of laminated laundry product like the one shown in FIG. 1 was made using a process like the ones outlined in FIGS. 9 and 10. The 48 cells, each approximately $1\times1\times0.13$ inches, contain a volume of about 2.1 cc each. The paper used is that paper hereinbefore described.

The product contained 24 cells of the detergent and 24 cells of the bleach mix. Each of the detergent cells contained about 0.9 g of detergent which is about 1.6 cc of powder. Each of the bleach cells contained about 1.4 g bleach or about 2.0 cc of bleach powder. The total amounts of laundry actives laminated in each sheet are set out in Table 1.

TABLE 1

| Ingredient | Grams Per Sheet |
|---|---|
| Sodium tripolyphospate | 5.70 |
| Sodium acid pyrophosphate | 5.00 |
| Linear alkyl benzene sulfonate | 8.50 |
| Silicone silicate | 0.15 |
| Tallow alkyl ethoxylate | 0.30 |
| Protease-amylase enzymes | 0.90 |
| Optical brighteners | 0.70 |
| Perfume | 0.15 |
| Total detergent mix | 21.40 |
| Bleach mix (3.0 g AvO from diperoxydodecanedioic acid) | 33.00 |
| Total weight on sheet | 54.40 |
| Paper | 7.9 |
| Hot melt adhesive | 1.5 |
| Total weight per sheet | 63.8 |

When these laminated products were placed in a washing machine, the cleaning performance was identical to that obtained when the equivalent amounts of laundry actives were used. The selection of paper and cell size insured the flow of water into the laminates and the flow of dissolved and suspended powders through the paper tissue. The powders were introduced into the wash liquor rapidly. By dividing the total amount of powder into 48 separate compartments, all the powder came into contact with water very rapidly which was important to keeping total dissolution time to a minimum.

At the end of the wash cycle, the laminates were examined and found to be intact except for the powders which had dissolved. The paper was wrinkled but untorn. The spent laminated sheet was not removed from the load of wet fabrics at this stage, but was carried along with the fabrics to the dryer. The spent sheet was dried with the rest of the fabrics. No problem was encountered in the dryer. The spent dried sheet was easily separated from the rest of the fabrics after the drying operation. Examination of the spent sheet showed the sheet was still intact after the drying cycle.

To further test the ability of the laminated sheet to withstand the rigors of the washing process, the laminated sheets were run through two washing cycles of a European washer, Mehle. This consisted of two 1-hour cycles with water temperatures ranging from room temperature to 205° F. (96° C.) with a full load of fabrics. Even with this rigorous treatment the laminated sheets remained intact and did not delaminate or split asunder.

What is claimed is:

1. A compact, through the wash laundry product comprising:

a laminate of two plies of which at least one ply comprises a strong, high stretch tissue made of synthetic fibers which is deeply embossed to form a multiplicity of nonconnecting cups surrounded by rims;

the tissue in each cup having been prestretched about 15% to about 100% by said deep embossing;

said cups containing a laundry active, said active being selected from powdered detergents, builders, brighteners, softeners, enzymes, bleach solids, fillers, and mixtures thereof;

the other of said two plies covering the deeply embossed ply forming patterned cells which contain the powder, said plies being sealed on said rims to provide said compact, through the wash laundry product;

said high stretch embossed ply originally having a dry CD stretch of about 9% to about 25% and a dry MD stretch of about 30% to about 60%, a wet cross-sectional tensile strength of about 78.7 to about 315 g/cm (200;14 800 g/in), said embossed ply selected to withstand the stretching and said two plies being selected to survive automatic washing and drying cycles without significant tearing; said tissue having sufficient porosity to permit the laundry actives to dissolve and flow through the tissue.

2. A compact, through the wash laundry product comprising:

a laminate consisting of at least two plies;

one of said plies being a high stretch tissue made of synthetic fibers which is deeply embossed to form a multiplicity of nonconnecting cups surrounded by rims, said deeply embossed ply being prestretched about 15% to about 100% from said deep embossing, said deeply embossed ply having a dry CD stretch of at least 12%, said cups containing laundry active powders selected from powdered detergents, builders, enzymes, softeners, brighteners, bleach solids, fillers, and mixtures thereof;

the other of said two plies covering the deeply embossed ply forming patterned cells which contain the powder, said plies being sealed on said rims;

said deeply embossed ply being selected to withstand the stretching and both of said plies being selected to survive automatic washing and drying cycles without significant tearing; said deeply embossed ply having sufficient porosity to permit the laundry actives to dissolve and flow through the said deeply embossed ply.

3. The laundry product of claim 1 or 2 wherein said tissue comprises synthetic fibers selected from polyester and polyolefin fibers and mixtures thereof.

4. The laundry product of claim 1 or 2 wherein said laminate comprises a ply which is made from polyester fibers.

* * * * *

UNITED STATES PATENT AND TRADEMARK OFFICE

CERTIFICATE OF CORRECTION

PATENT NO. : 4,817,788

DATED : April 4, 1989

INVENTOR(S) : William T. Bedenk and Kendall L. Harden

It is certified that error appears in the above-identified patent and that said Letters Patent is hereby corrected as shown below:

Title page, Abstract, line 5, "(stretched)" should be -- (prestretched) --.

Col. 3, line 12, "(stretched)" should be -- (prestretched) --.

Col. 14, line 19, (Claim 1), "(200;14 800 g/in)" should be -- (200-800 g/in) --.

Signed and Sealed this

Ninth Day of January, 1990

*Attest:*

JEFFREY M. SAMUELS

*Attesting Officer* *Acting Commissioner of Patents and Trademarks*